US006619710B1

(12) United States Patent
Hwang

(10) Patent No.: US 6,619,710 B1
(45) Date of Patent: Sep. 16, 2003

(54) ADJUSTABLE LOCK FOR VARIOUS DOOR THICKNESSES

(75) Inventor: Lien-Shi Hwang, Kaohsiung (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/237,791

(22) Filed: Sep. 10, 2002

(51) Int. Cl.[7] ..... E05B 3/00
(52) U.S. Cl. ..... 292/336.3; 292/348; 292/DIG. 53
(58) Field of Search ..... 292/1, 336.3, 348, 292/350, DIG. 53, DIG. 64, 357

(56) References Cited

U.S. PATENT DOCUMENTS 5,088,778 A * 2/1992 Lin ..... 292/336.3
5,626,039 A * 5/1997 Solari ..... 70/279
6,032,991 A * 3/2000 Yeh ..... 292/336.3
6,302,457 B1 * 10/2001 Shen ..... 292/357
6,364,383 B1 * 4/2002 Shen ..... 292/357

FOREIGN PATENT DOCUMENTS

DE 0 505 678 A1 * 1/1992 ..... E05C/9/02
GB 2233035 * 1/1991 ..... E05C/9/12

* cited by examiner

*Primary Examiner*—Gary Estremsky
(74) *Attorney, Agent, or Firm*—Bacon & Thomas, PLLC

(57) ABSTRACT

A lock for various door thicknesses comprises a latch bolt, a chassis, an inner spindle, an outer spindle, a retractor, and an outer handle assembly. The outer handle assembly comprises an outer rose liner, an outer rose, a ring threadedly engaged with the chassis, a gear meshed with the ring, and an outer handle. When the retractor is not aligned with a hook of the latch bolt during installation of the lock, a tool is extended through the outer rose liner into a non-circular hole of the gear to thereby turn the gear and the ring, thereby causing the ring to move relative to the outer tubular member and causing the outer rose liner and the outer rose to move relative to the chassis along a longitudinal direction of the chassis until the retractor is aligned with and engageable with the hook of the latch bolt.

12 Claims, 7 Drawing Sheets

ADJUSTABLE LOCK FOR VARIOUS DOOR THICKNESSES

BACKGROUND OF THE INVENTION

1. Field of the Invention

The present invention relates to an adjustable lock for various door thicknesses. In particular, the present invention relates to an adjustable cylindrical lock that can be conveniently and rapidly adjusted to suit the thickness of the door to which the lock is mounted.

2. Description of the Related Art

U.S. Pat. No. 5,265,924 to Kim issued on Nov. 30, 1993 discloses a lever assembly for a door lock. As illustrated in FIG. 6 of the drawings that corresponds to FIG. 1 of U.S. Pat. No. 5,265,924, the door lock includes a door lock cylinder 910, an outer spindle 911, an inner spindle 912, an outer spacer 921, a nut 922, an outer mounting member 923, an outer cover 924, an outer handle 925, an inner spacer 931, an inner mounting member 932, an inner cover 933, and an inner handle 934. The outer spindle 911 and the inner spindle 912 are respectively attached to two sides of the door lock cylinder 910. The door lock cylinder 910 includes an opening (not labeled) through which a retractor 913 extends, the retractor 913 being operably connected to a latch bolt 914.

The nut 922 includes an inner threading for threadedly engaging with an outer threading on a side of the door lock cylinder 910, allowing adjustment of the position of the retractor 913 and the latch bolt 914 so as to be aligned with a latch hole in an edge of the door. Thus, the lock can be used with doors with various thicknesses. Further, the lock can be used in a case that the latch hole is not located in a middle of the edge of the door. However, when it is desired to turn the nut 922 for moving the latch bolt 914 to suit the position of the latch hole in the door, many elements except the outer spacer 921 must be detached before turning of the nut 922. The lock core is located on an outer side of a typical cylindrical lock such that there are many complicated elements provided on the outer side of the cylindrical lock. When mounting the lock to a door, the elements on the inner side of the lock is firstly detached, and the lock is mounted into a transverse through-hole in the door from an outer side of the door. After attachment of the latch bolt 914, the detached elements are reassembled from an inner side of the door. However, if the latch bolt 914 could not be precisely aligned with the door lock cylinder due to thickness of the door, the outer handle 925, the outer cover 924, and the outer mounting member 923 must be detached before subsequent rotation of the nut 922 for adjusting the position of the latch bolt 914. Detachment and reassembly of the elements on the outer side of the lock are not easy, as positioning of the outer handle 925 is a problem due to the fact that the lock core is mounted in the outer handle 925. Thus, it is a problem not only to a D.I.Y user but also to a locksmith. In some cases, the cylindrical lock might even be damaged during detachment and reassembly.

FIG. 7 illustrates another conventional cylindrical lock that comprises a chassis 810, an outer spindle 811, an inner spindle 812, an outer rose liner 821, an outer rose 822, an outer escutcheon 823, an outer handle 824, an inner rose liner 831, an inner rose 832, an inner escutcheon 833, and an inner handle 834. Compared to the nut 922 in FIG. 6, an adjusting ring 825 for adjusting position of the latch bolt is integrally formed with the outer rose liner 822. The adjusting ring 825 also includes an inner threading 826 for threading engagement with an outer threading 813 on a side of the chassis 810. Thus, when the outer rose liner 821 (including the adjusting ring 825) is turned relative to the chassis 810, the axial position of a retractor (not shown) in the chassis 810 relative to a latch hole (not shown) of a door (not shown) is changed. Thus, the lock can be used with doors having various thicknesses and/or different latch hole positions. However, two positioning posts 827 and two mounting posts 828 project from the outer rose 822 toward an inner side of the door and extend through holes in the outer rose liner 821 to thereby secure the chassis 810 and to thereby connect the inner rose liner 831 and the inner rose 832. Thus, the adjusting ring 825 attached to the outer rose 822 is fixed and therefore could not be turned. When adjustment of the position of the latch bolt for alignment with the latch hole in the door via rotation of the adjusting ring 825 is required, many elements except the outer rose liner 821 must be detached before the adjusting operation. Reassembly is also troublesome. The lock might even be damaged due to improper detachment.

SUMMARY OF THE INVENTION

It is the primary object of the present invention to provide an adjustable lock that can be conveniently and rapidly adjusted to suit the thickness of the door to which the lock is mounted. Thus, the adjustable lock can be used with doors of various thicknesses.

A lock for various door thicknesses in accordance with the present invention comprises a latch assembly including a latch bolt with a hook, a chassis including an inner tubular member on an inner end thereof and an outer tubular member on an outer end thereof, the outer tubular member including an outer threading, an inner spindle having an end pivotally and coaxially mounted in the chassis, an outer spindle having an end pivotally and coaxially mounted in the chassis, a retractor mounted in the chassis and operably connected to the inner spindle and the outer spindle and operably connected to the hook of the latch bolt of the latch assembly such that rotation of either the inner spindle or the outer spindle causes retraction of the latch bolt, an outer handle assembly, and an inner handle assembly.

The outer handle assembly comprises an outer rose liner including a central hole so as to be mounted around the outer tubular member, the outer rose liner including a through-hole, an outer rose including a central hole so as to be mounted around the outer tubular member, a central compartment and a side compartment being defined between the outer rose and the outer rose liner, a ring rotatably mounted in the central compartment, the ring having an inner threading for threading engagement with the outer threading of the outer tubular member, the ring further including a plurality of teeth on an outer periphery thereof, a gear rotatably mounted in the side compartment, the gear including a non-circular hole aligned with the through-hole of the outer rose liner, the gear further including a plurality of teeth meshed with the teeth of the ring, and an outer handle having an end securely attached to the outer spindle to turn therewith.

The inner handle assembly is attached to the inner tubular member and the inner spindle. When the retractor is not aligned with the hook of the latch bolt during installation of the lock, a tool is extended through the through-hole of the outer rose liner into the non-circular hole of the gear to thereby turn the gear and the ring, thereby causing the ring to move relative to the outer tubular member and causing the outer rose liner and the outer rose to move relative to the chassis along a longitudinal direction of the chassis until the retractor is aligned with and engageable with the hook of the latch bolt.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

A preferred embodiment in accordance with the present invention will now be described with reference to the accompanying drawings.

Figure 1:
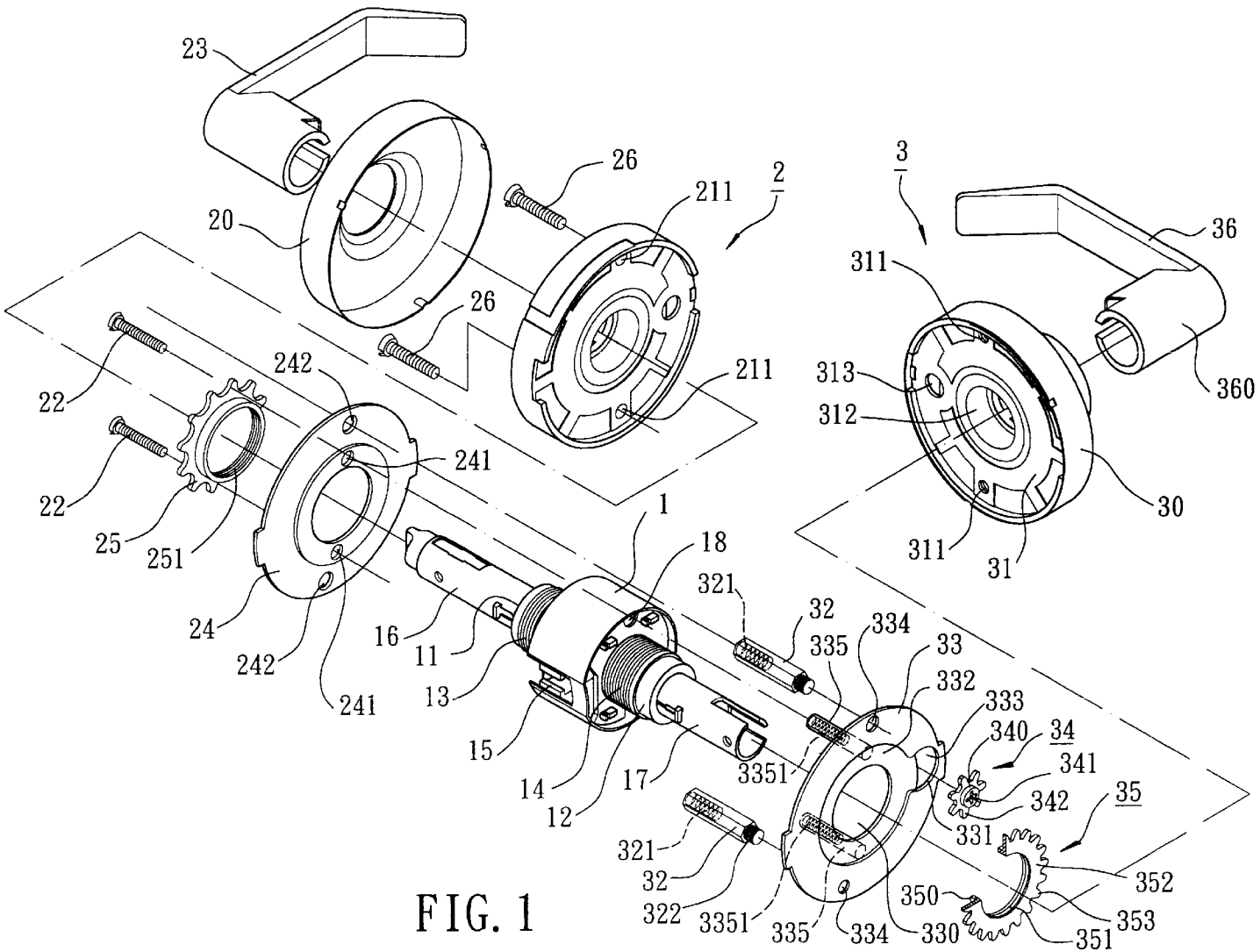
FIG. 1 is an exploded perspective view of a lock in accordance with the present invention.

Referring to FIG. 1, a lock in accordance with the present invention generally includes a chassis 1, an outer handle assembly 3, and an inner handle assembly 2. In this embodiment, the lock is a cylindrical lock.

Figure 2:
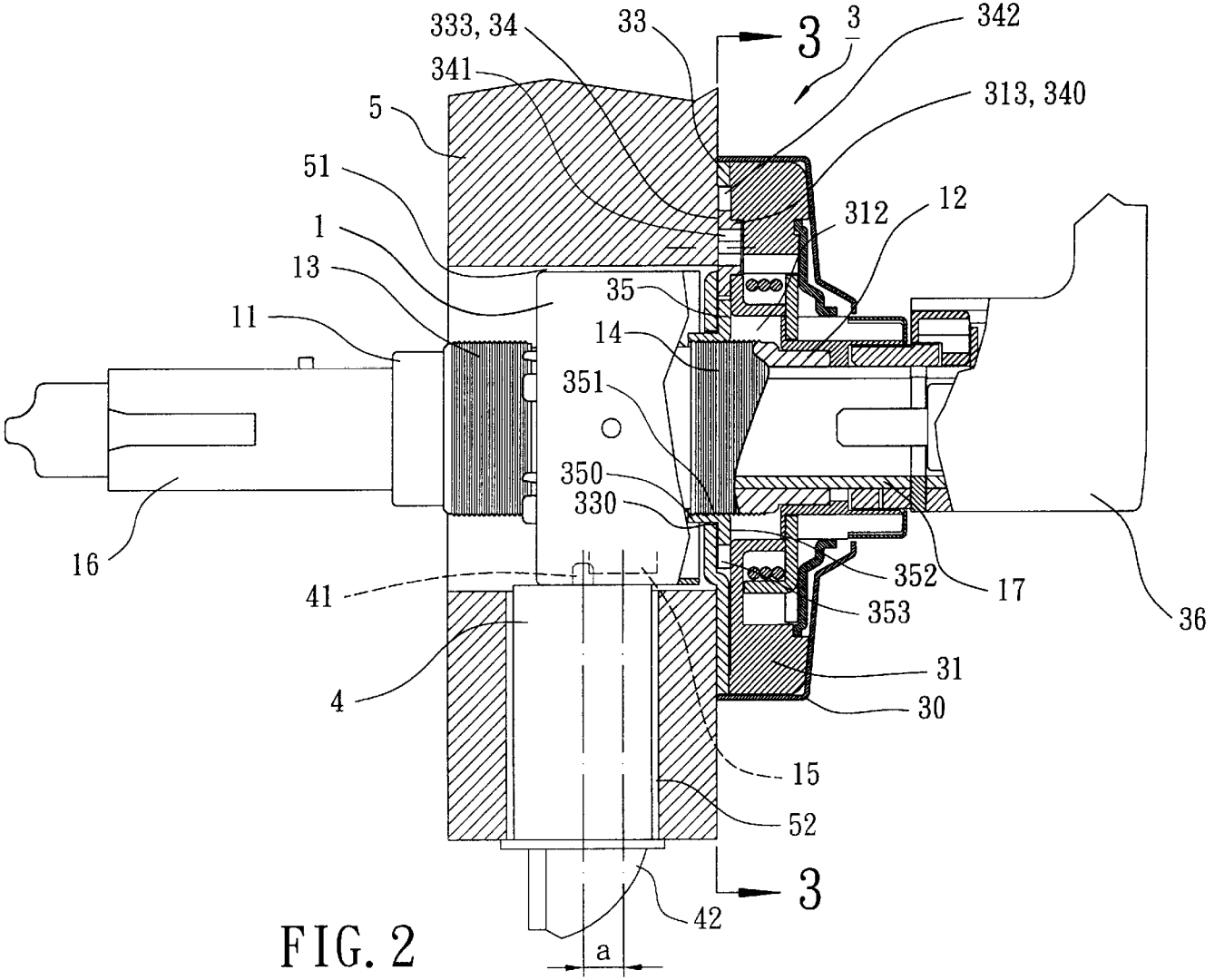
FIG. 2 is a sectional view of the lock mounted to a door, wherein a chassis and an outer handle assembly are not in their proper position.

The chassis 1 includes an inner tubular member 11 on an inner end thereof and an outer tubular member 12 on an outer end thereof. The inner tubular member 11 has an outer threading 13 on an outer periphery thereof, and the outer tubular member 12 has an outer threading 14 on an outer periphery thereof. An inner spindle 16 has an end pivotally and coaxially mounted in the inner tubular member 11, and an outer spindle 17 has an end pivotally and coaxially mounted in the outer tubular member 12. Thus, both the inner spindle 16 and the outer spindle 17 are pivotable relative to the chassis 1 for driving a retractor 15 that is attached to a hook 41 on an end of a latch assembly 4, thereby retracting a latch bolt 42 of the latch assembly 4 (FIG. 2).

The outer handle assembly 3 includes a handle 36, an outer escutcheon 30, an outer rose 31, an outer rose liner 33, a gear 34, and a ring 35. The outer escutcheon 30 covers an outer side of the outer rose 31. The handle 36 includes a shank 360 that extends through a central hole 312 of the outer rose 31 and that is connected to the outer spindle 17 to turn therewith. Thus, when the outer handle 36 is turned, the outer spindle 17 is also turned to actuate the retractor 15 for retracting the latch bolt 42.

The outer rose liner 33 includes a central hole 330 for rotatably receiving an annular flange 350 formed on a side of a ring body 352 of the ring 35. The outer rose liner 33 and the outer rose 31 together define a compartment for accommodating the ring 35 and the gear 34. The compartment can be directly defined in either the outer rose liner 33 or the outer rose 31. In this embodiment, the compartment includes a central compartment 332 and a side compartment 331 in a side of the outer rose liner 33. The body 352 of the ring 35 is received in the central compartment 332 and abuts against a bottom ball defining the central compartment 332, and the annular flange 350 of the ring 35 extends through the central hole 330 of the outer rose liner 33. The ring 35 includes a threading 351 in an inner periphery thereof and a plurality of teeth 353 on an outer periphery thereof. A side of the central compartment 332 of the outer rose liner 33 is communicated with the side compartment 331 of the outer rose liner 33. Further, the outer rose liner 33 includes a through-hole 331 that is communicated with the side compartment 331. The side compartment 331 of the outer rose liner 33 receives the gear 34 having a plurality of teeth 342 on an outer periphery thereof for meshing with the teeth 353 of the ring 35. An axle 340 is formed on a side of the gear 34 and pivotally received in a hole 313 in the outer rose 31. The gear 34 further includes a non-circular hole 341 (preferably cruciform).

The outer rose liner 33 includes two holes 334 through which two rods 32 respectively extend. Each rod 32 includes a threaded portion 322 extending through an associated hole 334 into an associated one of two screw holes 311 in the outer rose 31. Thus, the outer rose liner 33 is secured to the outer rose 31, and the ring 35 and the gear 34 are respectively restrained in the central compartment 332 and the side compartment 331 of the outer rose liner 33. Two guide posts 335 project from a side of the outer rose liner 33 and respectively extend through two holes 18 in the chassis 18. Each guide post 335 has a screw hole 3351 in an end thereof.

The inner handle assembly 2 includes an inner handle 23, an inner escutcheon 20, an inner rose 21, an inner rose liner 24, and a ring 25. In assembly, the inner rose liner 24 is mounted on the inner tubular member 11 with an inner threading 251 of the ring 25 being threadedly engaged with the outer threading 13 of the inner tubular member 11. The inner rose liner 24 is pressed against the door, and two bolts or screws 22 are respectively extended through two holes 241 in the inner rose liner 24 and the holes 18 in the chassis 1 into screw holes 3351 of the guide posts 335. The inner rose 21 is then pressed against the inner rose liner 24, and two bolts or screws 26 are respectively extended through two holes 211 of the inner rose 21 and two holes 242 in the inner rose liner 24 into the screw holes 321 of the rods 32. Next, the inner escutcheon 20 is mounted to an outer side of the inner rose 21, and the inner handle 23 is secured to the inner spindle 16 to finish the installation of the lock.

Referring to FIG. 2, when installing the cylindrical lock in accordance with the present invention on a door 5, the inner handle assembly 2 is detached at first, and the chassis 1 is placed from an outer side of the door 1 into a through-hole 51 in the door 5. The latch assembly 4 is placed into the a latch hole 52 in the door 5 with the hook 41 of the latch assembly 4 being engaged with the retractor 15. The inner handle assembly 2 is then reassembled to complete the installation. Nevertheless, since the door may not have a uniform thickness such that the retractor 15 might not be engaged with the hook 41 of the latch assembly 4, as shown in FIG. 2. Namely, an offset "a" exists between a central line of the retractor 15 and a central line of the hook 41. Adjustment is thus required.

Figure 3:
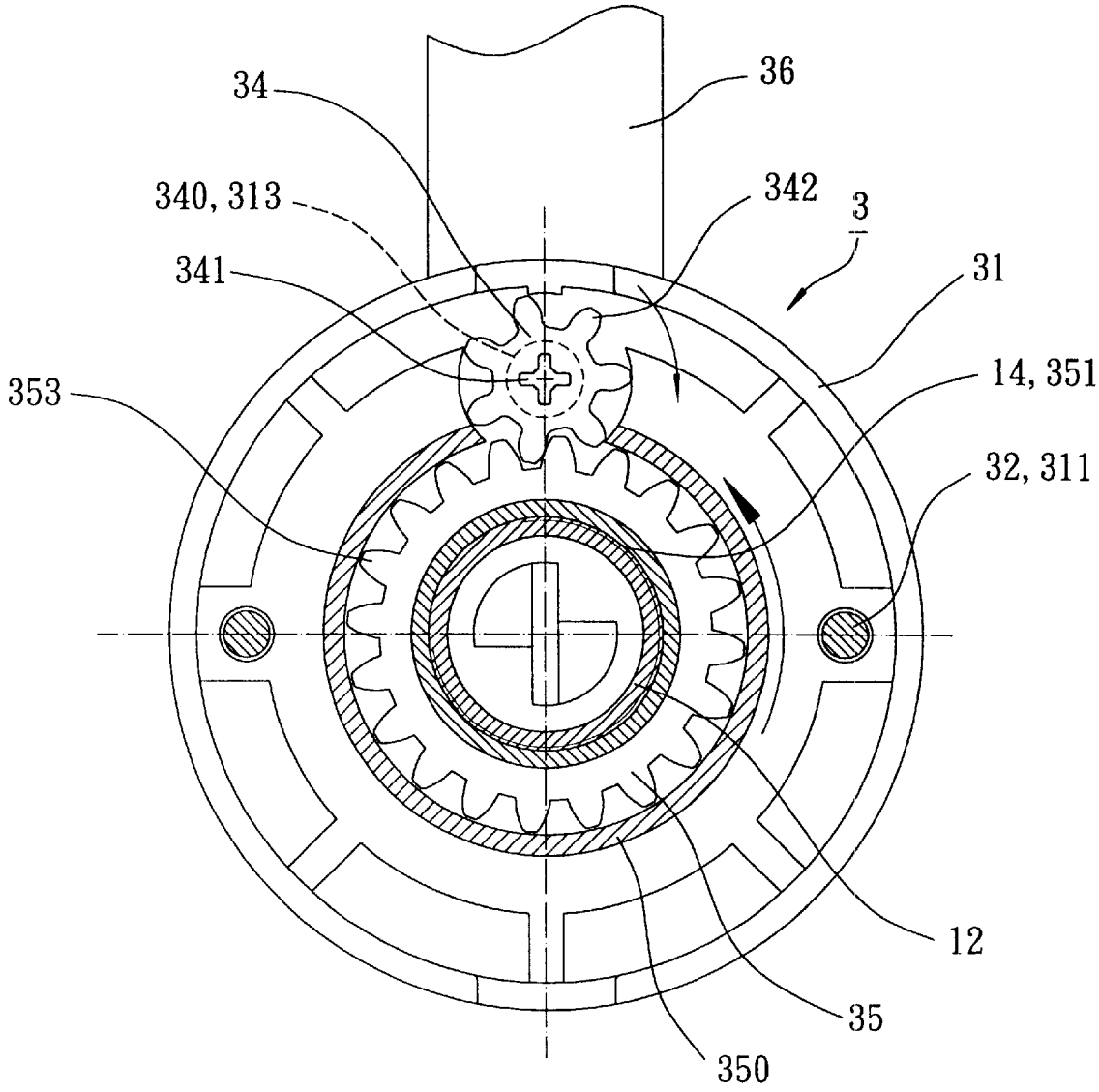
FIG. 3 is a sectional view taken along plane 3—3 in FIG. 2.
Figure 4:
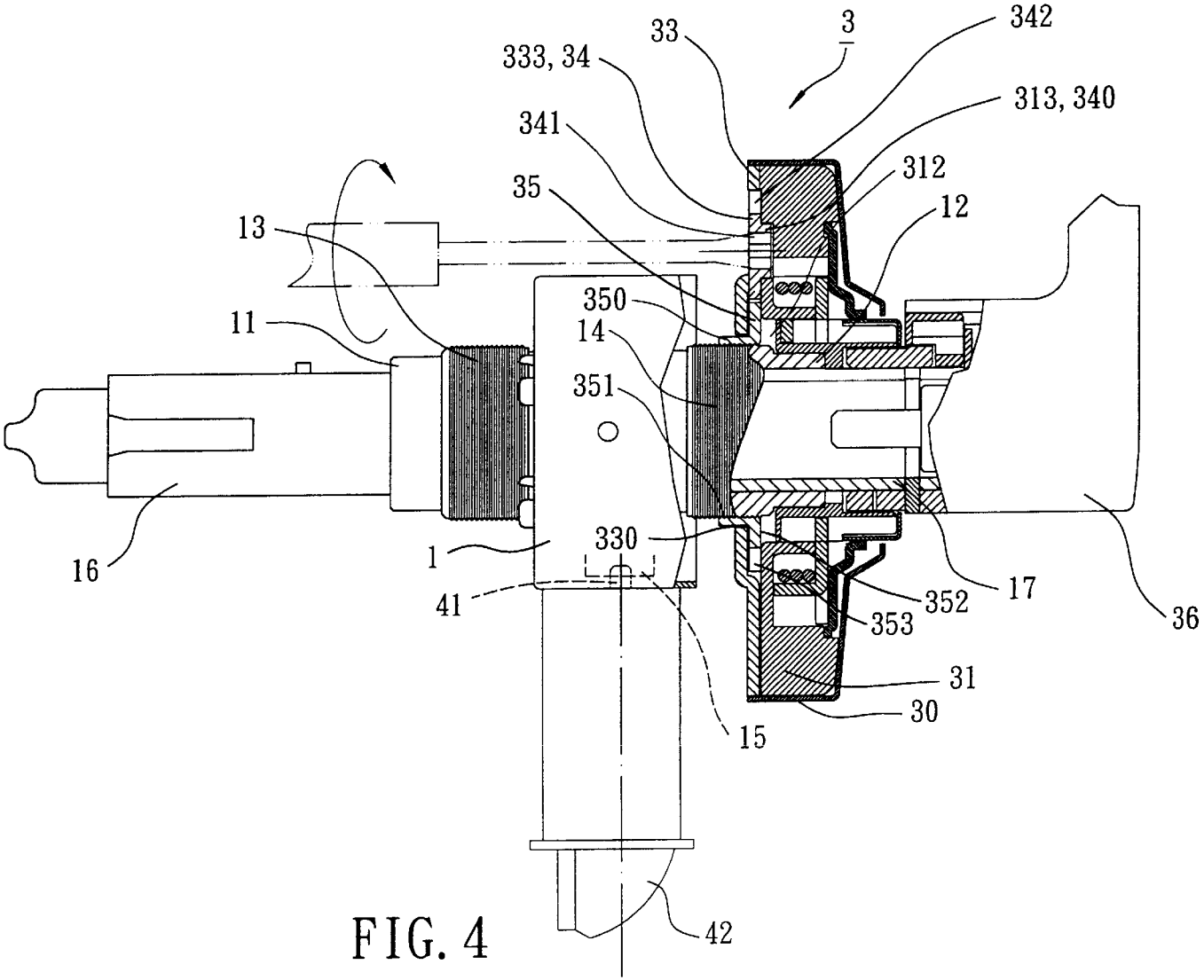
FIG. 4 is a sectional view similar to FIG. 2, wherein the chassis and the outer handle assembly are in their proper position.

Referring to FIGS. 3 and 4, when it is desired to adjust the retractor 15 to a position in alignment with the hook 41 of the latch assembly, a tool (such as a screwdriver, see FIG. 4) is extended through the through-hole 333 of the outer rose liner 33 into the non-circular hole 341 of the gear 34 and then turns the gear 34. Since the gear 34 is located in the side compartment 331 of the outer rose liner 33 with the axle 340 being pivotally received in the hole 313 of the outer rose 31, the ring 35 is turned due to meshing between the teeth 342 of the gear 34 and the teeth 353 of the ring 35. Further, since the annular flange 350 on the ring 35 has an inner threading 351 is threadedly engaged with the outer threading 14 on the outer tubular member 12 and since the ring 35 is restrained in the central compartment 332 between the outer rose 31 and the outer rose liner 33, the ring 35 is capable of moving along the outer periphery of the outer tubular member 12 in a longitudinal direction. Thus, the whole outer handle assembly 3 (except the outer handle 36) is moved relative to the chassis 1. Further, since the guide posts 35 of the outer rose liner 33 are extended through the holes 18 of the chassis 1, the outer rose liner 33 and the outer rose 31 are not turned relative to the chassis 1. As a result, the longitudinal position of the outer rose liner 33 and the outer rose 31 of the outer handle assembly 3 relative to the chassis 1 is adjustable. Namely, the retractor 15 may be moved to a position in alignment with the hook 41 of the latch assembly 4 for reliable engagement therebetween, best shown in FIG. 4. The adjusting procedure is accomplished before the lock is mounted to the door, and the thickness of the door and/or position of the latch hole are measured before proceeding with the adjustment.

Figure 5:
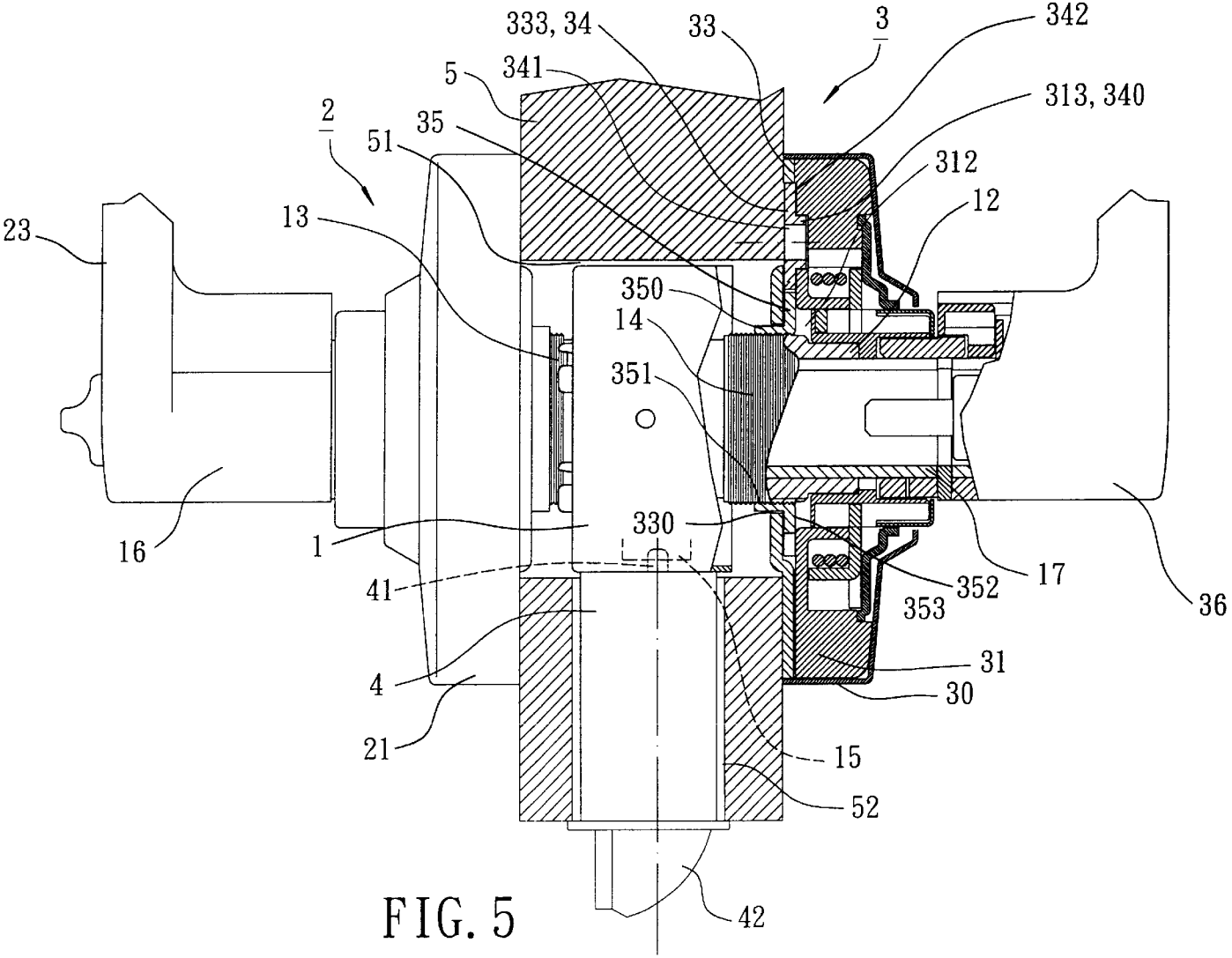
FIG. 5 is a sectional view of the lock after installation.
Figure 6:
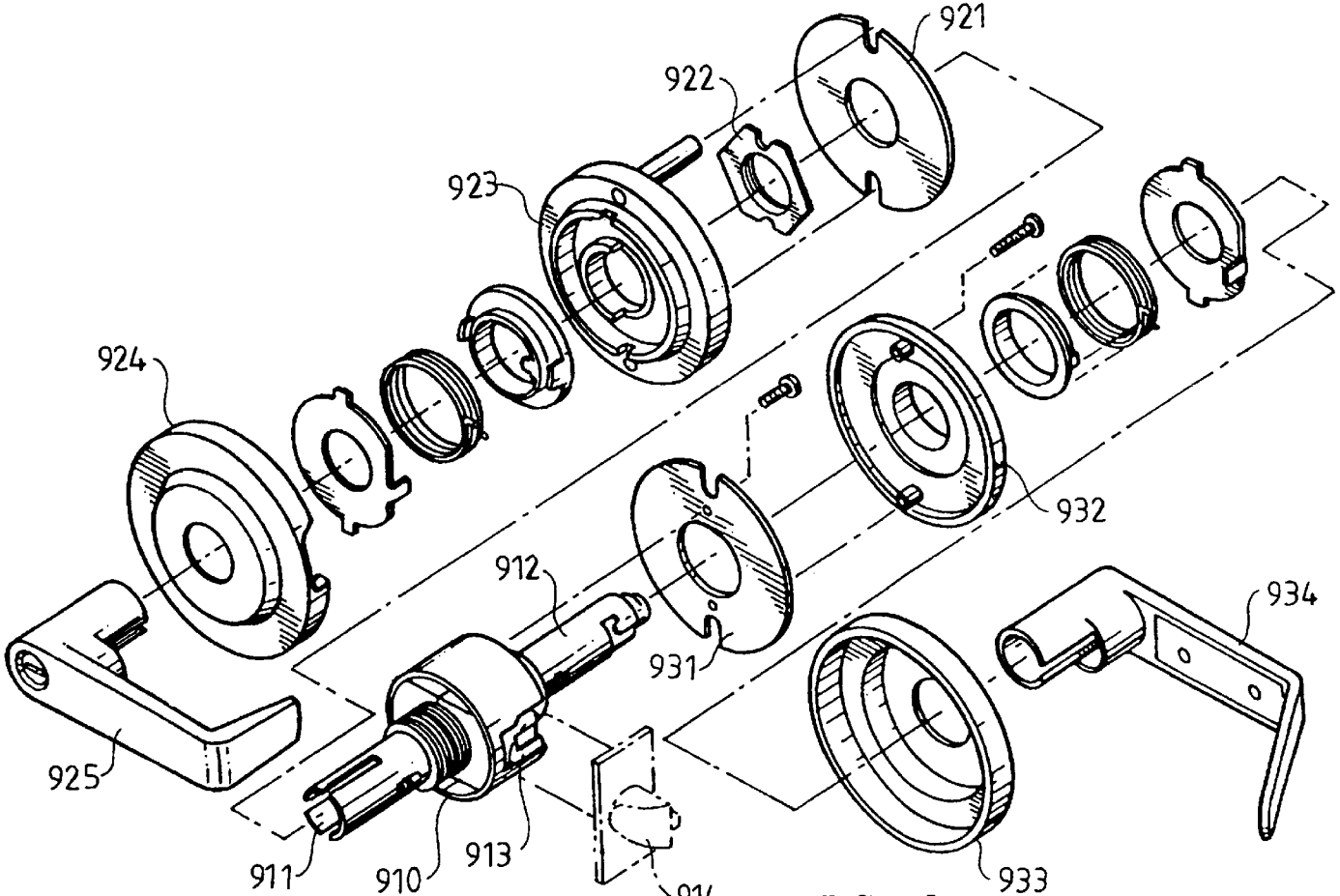
FIG. 6 PRIOR ART
FIG. 6 is an exploded perspective view of a conventional cylindrical lock.
Figure 7:
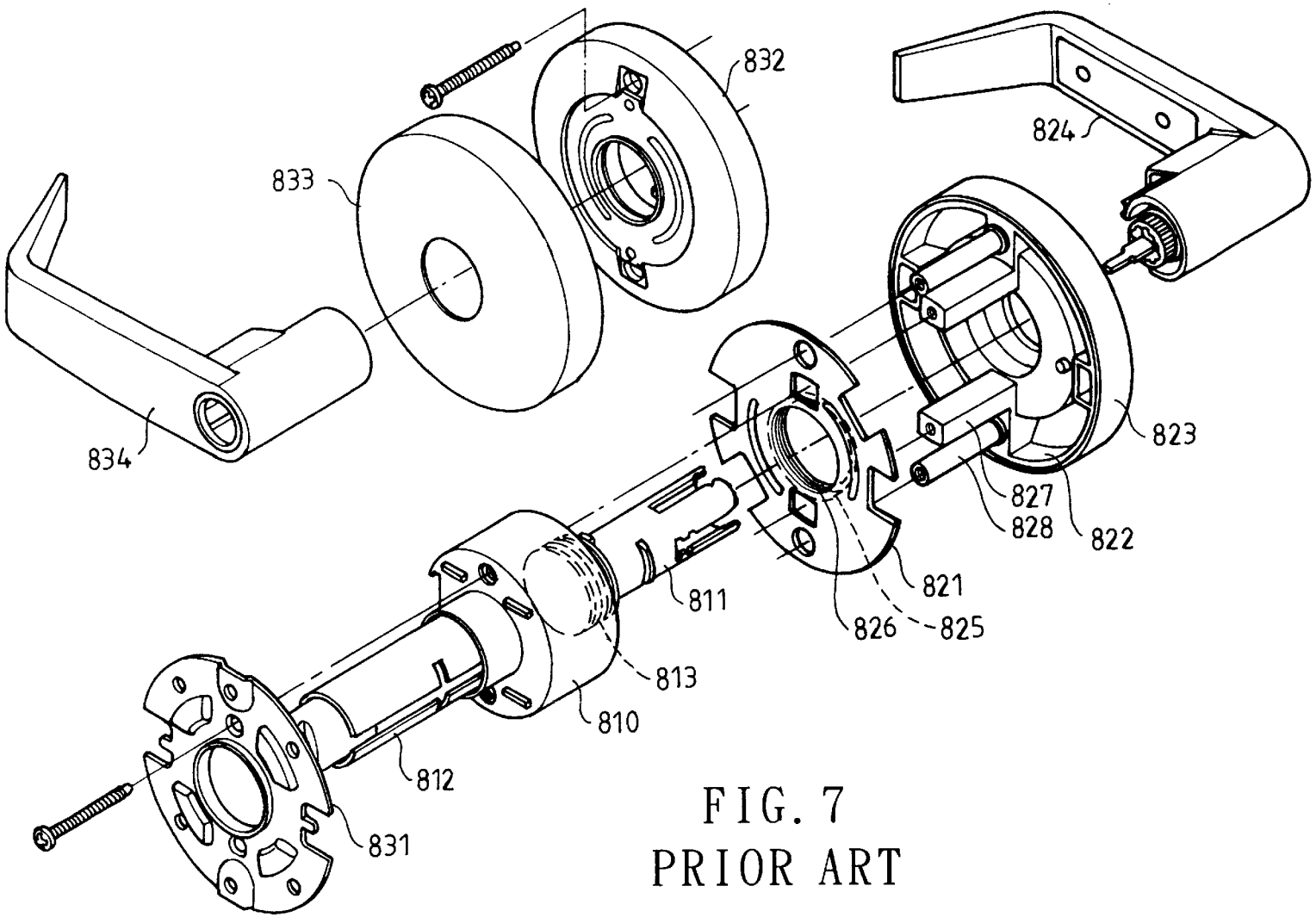
FIG. 7 PRIOR ART
FIG. 7 is an exploded perspective view of another conventional cylindrical lock.

Referring to FIG. 5, after adjustment, the outer handle assembly 3 is attached to the chassis 1 from the outer side of the door via the through-hole 51 of the door 51. The latch assembly 4 is mounted into the latch hole 52 with the hook 41 being engaged with the retractor 15. The inner handle assembly 2 is then reassembled to the chassis 1 to finish the installation.

Another way to adjusting the position of the retractor 15 in the chassis 1 (also the position of the outer handle 36 securely connected to the outer spindle 17 of the chassis 1) relative to the outer rose 31 and the outer rose liner 33 is to mount the lock onto the door and proceed with the adjustment directly on the site.

The lock in accordance with the present invention can be mounted to doors having various door thicknesses by means of simple turning of the gear 34 by a tool. The ring 35 is driven to cause the outer handle assembly 3 (except the outer handle 36) to move longitudinally relative to the outer tubular member 12. The position of the outer handle assembly relative to the chassis 1 is thus changed. As a result, the inner handle assembly 2 and the outer handle assembly 3 can be mounted to doors with various door thicknesses, and the retractor 15 can be rapidly aligned with the hook 41 of the latch assembly 4 through adjustment that can be accomplished easily and rapidly.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A lock for various door thicknesses, the lock comprising:

a latch assembly including a latch bolt with a hook;

a chassis including an inner tubular member on an inner end thereof and an outer tubular member on an outer end thereof, said outer tubular member including an outer threading, an inner spindle having an end pivotally and coaxially mounted in said chassis, an outer spindle having an end pivotally and coaxially mounted in said chassis, a retractor being mounted in said chassis and operably connected to said inner spindle and said outer spindle and operably connected to said hook of said latch bolt of said latch assembly such that rotation of either said inner spindle or said outer spindle causes retraction of said latch bolt;

an outer handle assembly comprising:

an outer rose liner including a central hole so as to be mounted around said outer tubular member, said outer rose liner including a through-hole;

an outer rose including a central hole so as to be mounted around said outer tubular member, a central compartment and a side compartment being defined between said outer rose and said outer rose liner;

a ring rotatably mounted in said central compartment, said ring having an inner threading for threading engagement with said outer threading of said outer tubular member, said ring further including a plurality of teeth on an outer periphery thereof;

a gear rotatably mounted in said side compartment, said gear including a non-circular hole aligned with said through-hole of said outer rose liner, said gear further including a plurality of teeth meshed with said teeth of said ring; and an outer handle having an end securely attached to said outer spindle to turn therewith; and an inner handle assembly attached to said inner tubular member and said inner spindle;

wherein when said retractor is not aligned with said hook of said latch bolt during installation of the lock, a tool being extended through said through-hole of said outer rose liner into said non-circular hole of said gear to thereby turn said gear and said ring, thereby causing said ring to move relative to said outer tubular member and causing said outer rose liner and said outer rose to move relative to said chassis along a longitudinal direction of said chassis until said retractor is aligned with and engageable with said hook of said latch bolt.

2. The lock as claimed in claim 1, wherein said central compartment and said side compartment are defined in a side of said outer rose liner.

3. The lock as claimed in claim 2, wherein said ring includes an annular flange formed on a side thereof, said annular flange being rotatably received in said central hole of said outer rose liner.

4. The lock as claimed in claim 1, wherein said gear includes an axle formed on a side thereof, said outer rose including a hole for rotatably receiving said axle.

5. The lock as claimed in claim 2, wherein said gear includes an axle formed on a side thereof, said outer rose including a hole for rotatably receiving said axle.

6. The lock as claimed in claim 1, wherein said outer rose liner includes two guide posts projecting from a side thereof, each said guide post having a screw hole in an end thereof, said chassis including two holes, said guide posts respectively extending through said holes of said chassis such that said outer rose liner is not rotatable relative to said chassis but said outer rose liner is movable relative to said chassis along said longitudinal direction of said chassis.

7. The lock as claimed in claim 1, wherein said non-circular hole of said gear is cruciform, and said tool is a screwdriver for turning said gear.

8. The lock as claimed in claim 1, wherein said outer rose includes two screw holes, said outer rose liner includes two holes, further including two rods each having a threaded end extending through an associated one of said holes of said outer rose liner into an associated one of said screw holes of said outer rose, thereby securing said outer rose and said outer rose liner together.

9. The lock as claimed in claim 6, wherein each said guide post includes a screw hole in an end thereof, further including two screws extending through said inner handle assembly into said screw holes of said guide posts, thereby respectively attaching said inner handle assembly and said outer handle assembly on both sides of a door.

10. The lock as claimed in claim 8, wherein each said rod includes a screw hole in an end thereof, further including two screws extending through said inner handle assembly into said screw holes of said rod, thereby respectively attaching said inner handle assembly and said outer handle assembly on both sides of a door.

11. The lock as claimed in claim 2, wherein said outer rose liner includes two guide posts projecting from another side thereof, each said guide post having a screw hole in an end thereof, said chassis including two holes, said guide post respectively extending through said two holes of said chassis such that said outer rose liner is not rotatable relative to said chassis but said outer rose liner is movable relative to said chassis along a longitudinal direction of said chassis.

12. The lock as claimed in claim 2, wherein said through-hole of said outer rose liner is communicated with said side compartment.

* * * * *